US006794472B2

(12) United States Patent
Harris et al.

(10) Patent No.: US 6,794,472 B2
(45) Date of Patent: Sep. 21, 2004

(54) SELF HEALING POLYMERS IN SPORTS EQUIPMENT

(75) Inventors: Kevin M Harris, New Bedford, MA (US); Murali Rajagopalan, South Dartmouth, MA (US)

(73) Assignee: Acushnet Company, Fairhaven, MA (US)

( * ) Notice: Subject to any disclaimer, the term of this patent is extended or adjusted under 35 U.S.C. 154(b) by 87 days.

(21) Appl. No.: 10/229,426

(22) Filed: Aug. 28, 2002

(65) Prior Publication Data

US 2003/0032758 A1 Feb. 13, 2003

Related U.S. Application Data

(63) Continuation-in-part of application No. 10/176,720, filed on Jun. 21, 2002.

(60) Provisional application No. 60/300,124, filed on Jun. 22, 2001.

(51) Int. Cl.[7] ..... A63B 37/00; A63B 37/02; A63B 37/12; C08F 234/02

(52) U.S. Cl. ..... 526/262; 526/270; 528/322; 473/354; 473/371; 473/374; 473/378

(58) Field of Search ..... 526/262, 270; 528/322; 473/354, 371, 374, 378

(56) References Cited

U.S. PATENT DOCUMENTS 5,823,891 A 10/1998 Winskowicz ..... 473/378
5,938,544 A 8/1999 Winskowicz ..... 473/378
6,271,335 B1 * 8/2001 Small et al. ..... 528/170

OTHER PUBLICATIONS

Chen, "A Thermally Re–Mendable Crosslinked Polymeric Material", SCIENCE vol. 295 pp. 1698–1702; Mar. 2002.*

*Providence Sunday Journal* "UCLA Scientists Develop a Plastic that Mends Itself" Mar. 10, 2002, p. A20.

*Chemical & Engineering News* "Polymer, Heal Thyself" Mar. 4, 2002, p. 35.

*Maxim* "Self–Healing Plastic" Jul. 2001, p. 101.

Janice Long and Janet S. Dodd, eds. "Plastic Mends Its Own Cracks" *Chemical & Engineering News*, Feb. 19, 2001, p. 13.

S.R. White, N.R. Sottos, P.H. Geubelle, J.S. Moore, M.R. Kessler, S.R. Sriram, E.N. Brown, and S. Viswanathan "Autonomic Healing of Polymer Composites" *Nature*, vol. 409, Feb. 15, 2001.

M. Ahmed, T. Arnauld, A.G.M. Barrett, D.C. Braddock, K. Flack, and P.A. Procopiou "Alene Cross–Metathesis: Synthesis of 1,3–Disubstitued Allenes" *Organic Letters*, vol. 2(4), Jan. 4, 2000, p. 551.

* cited by examiner

*Primary Examiner*—David J. Buttner
(74) *Attorney, Agent, or Firm*—William B. Lacy

(57) ABSTRACT

A golf ball comprising a core and a cover disposed concentrically about the core, wherein at least one of the core or the cover is formed of a polymer comprising thermally reversible covalent bonds. Additionally, a composition for sporting equipment formed of a polymer comprising thermally reversible covalent bonds.

14 Claims, No Drawings

SELF HEALING POLYMERS IN SPORTS EQUIPMENT

CROSS REFERENCE TO RELATED APPLICATIONS

This application is a continuation-in-part of U.S. application Ser. No. 10/176,720, filed Jun. 21, 2002, pending which claims priority to U.S. Provisional Application No. 60/300,124, filed Jun. 22, 2001, both of which are incorporated herein, in their entirety, by express reference thereto.

FIELD OF THE INVENTION

The present invention relates to golf balls and, in particular, to self-healing polymeric compositions useful in golf ball covers, cores, and intermediate layers to improve the durability of the golf ball during the impact.

BACKGROUND OF THE INVENTION

The majority of golf balls commercially available today can be grouped into two general classes: solid and wound. Solid golf balls include one-piece, two-piece, and multi-layer golf balls. One-piece golf balls are inexpensive and easy to construct, but have limited playing characteristics and their use is usually confined to the driving range. Two-piece balls are generally constructed with a polybutadiene solid core and a cover and are typically the most popular with recreational golfers because they are very durable and provide good distance. These balls are also relatively inexpensive and easy to manufacture, but are regarded by top players as having limited playing characteristics. Multi-layer golf balls are comprised of a solid core and a cover, either of which may be formed of one or more layers. These balls are regarded as having an extended range of playing characteristics, but are more expensive and difficult to manufacture than are one- and two-piece golf balls.

Wound golf balls, which typically include a fluid-filled center surrounded by tensioned elastomeric material and a cover, are preferred by many players due to their spin and "feel" characteristics but are more difficult and expensive to manufacture than are most solid golf balls. Manufacturers are constantly striving, therefore, to produce a solid ball that retains the beneficial characteristics of a solid ball while concurrently exhibiting the beneficial characteristics of a wound ball.

Golf ball playing characteristics, such as compression, velocity, "feel," and, therefore, spin, can be adjusted and optimized by manufacturers to suit players having a wide variety of playing abilities. For example, manufacturers can alter any or all of these properties by changing the materials (i.e., polymer compositions) and/or the physical construction of each or all of the various golf ball components (i.e., centers, cores, intermediate layers, and covers). Finding the right combination of core and layer materials and the ideal ball construction to produce a golf ball suited for a predetermined set of performance criteria is a challenging task.

The present invention is related to golf ball materials comprising at least one polymer and at least one healing agent to improve impact durability. Polymers are macromolecules built up by the linking together of large number of smaller molecules called monomers. Upon repetitive impact, the golf balls formed of many types of polymers tend to develop micro-cracks. One aspect of this invention is a way to make a polymeric golf ball component that is "repairable" through heating and cooling of the polymer backbone. No catalyst, monomers, or special surface treatments are required. The repaired plastic is believed to regain much of the strength of undamaged polymeric material. There is, therefore, a need for development of suitable healing agents that can be utilized to impart improved durability to golf ball cores, covers, and intermediate layers.

SUMMARY

The present invention is directed to a golf ball including a core and a cover disposed concentrically about the core, wherein at least one of the core or the cover is formed of a polymer including thermally reversible covalent bonds. At least about 20%, preferably at least about 30%, of the thermally reversible covalent bonds disconnect upon heating and re-connect upon cooling. Ideally, the reversible bonds disconnect at a temperature less than about 150° C., more preferably less than about 120° C., most preferably less than about 100° C.

The thermally reversible polymer typically include at least one furan diene unit and at least one amine comprising maleimide dienophiles. The furan diene units have the formula:

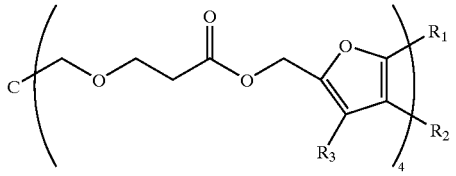

where $R_1$, $R_2$, and $R_3$ are hydrogen, alkyl, or aryl groups; and the amine comprising maleimide dienophiles has the formula:

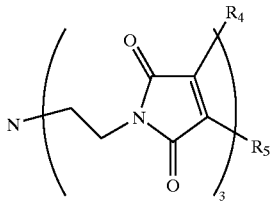

where $R_4$, and $R_5$ are hydrogen, alkyl, or aryl groups. Preferably, the polymer includes at least 4 furan diene units and at least 3 maleimide dienophiles.

The ball can be of any construction, but preferably the core comprises a center and an outer core layer. In one construction, the center includes a solid center, a hollow center, a gel, or a fluid. Alternatively, the cover comprises an inner cover layer and an outer cover layer, either one of which has a thickness of between about 0.03 inches and about 0.125 inches, Additionally, at least one of the core or cover may be foamed, includes a density-modifying filler, or both.

The present invention is also directed to a composition for sporting equipment formed of a polymer comprising thermally reversible covalent bonds. At least about 20%, preferably at least about 30%, of the thermally reversible covalent bonds disconnect upon heating and re-connect upon cooling. Ideally, the reversible bonds disconnect at a temperature of less than about 150° C., more preferably less than about 120° C., and most preferably less than about 100° C. The thermally reversible polymer typically include at least one furan diene unit and at least one amine including maleimide dienophiles. The furan diene units have the formula:

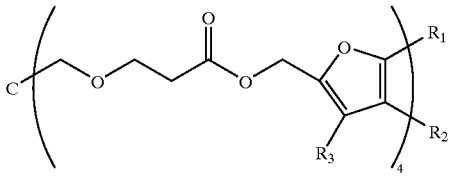

where $R_1$, $R_2$, and $R_3$ are hydrogen, alkyl, or aryl groups; and the amine includes maleimide dienophiles has the formula:

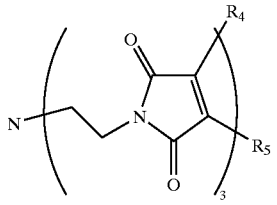

where $R_4$, and $R_5$ are hydrogen, alkyl, or aryl groups.

DETAILED DESCRIPTION OF EMBODIMENTS

The golf balls of the present invention may comprise any of a variety of constructions. For example, the core of the golf ball may comprise a solid core surrounded by a cover layer. The core may be a single layer or may comprise a plurality of layers, such as a center and an outer core layer. In such a construction, the innermost portion of the core, the center, may be solid or a liquid filled sphere surrounded with an outer core layer. As with the core, the cover layer may also comprise a plurality of layers. For example, the cover may be formed of an inner and an outer cover layer. Additionally, the core, solid or otherwise, may also be surrounded by a wound layer of elastomeric material, generally tensioned. Any of these components may comprise the self-healing polymers of the present invention.

The polymeric compositions may include at least one of a base material and a microencapsulated healing agent. For the base material, the bulk of the golf ball material can be a thermoplastic, such as SURLYN®, or a thermoset, such as polyurethane, polyurethane-urea, polyurea-urethane, polyurea, or crosslinked polybutadiene. Microencapsulated healing agents are the "glue" that fixes the micro-cracks formed in the composite material. This healing agent is typically a fluid such as dicyclopentadiene ("DCPD"). DCPD is preferably encapsulated in tiny spheres or capsules that are spread throughout the polymeric material. Preferably, there are about 100 to about 200 capsules per cubic inch. Preferably, the spheres are about 300 $\mu$m or less in diameter.

In order to polymerize, the healing agent must come into contact with a catalyst. A preferred catalyst, called Grubbs catalyst, is used for this self-healing material. It is important that the catalyst and healing agent remain separated until they are needed to seal a crack. When a micro-crack forms in the base material, it will spread through the material. By doing so, this crack will rupture the microcapsules and release the healing agent. This healing agent will flow down through the crack and will inevitably come into contact with the Grubbs' catalyst, which initiates the polymerization process. This process will eventually bond the crack closed.

In a preferred embodiment, the self-healing polymer blend has a flexural modulus of from about 2,000 to about 200,000 psi contains microcapsules filled with dicyclopentadiene, dicyclohexa (or penta or octa) diene, (a liquid tricyclic diolefin), and a polymerization catalyst dispersed throughout the cover (in one embodiment) would be a ruthenium carbene complex, known as a "Grubbs catalyst." One source of the Grubbs catalyst is from Strem Chemicals, 7 Mulliken Way, Newburyport, Mass. The Grubbs ruthenium-based catalyst is very efficient at initiating various reactions including olefin metathesis with high functional group tolerance. Unfortunately, we would quickly deplete the world of its supply of ruthenium if we were to use it for all its applications. Looking at related elements that have a higher natural abundance leads to iron, osmium, rhodium, iridium, palladium and platinum. It is believed that iron should have similar electronic behavior, which could lead to a successful iron based olefin metathesis catalyst. In addition, it is believed that the use of living (uninterrupted chain ends) polymerization catalysts is preferred, allowing multiple healing opportunities. The catalyst is commercially available from Advanced Polymer Technologies, Inc. and Hitachi Chemical.

Other suitable self-healing polymeric materials include polymeric networks consisting of a backbone that is linked through thermally reversible covalent bonds. At temperatures less than either the melting point or glass transition temperature of the polymer, preferably less than about 150° C., more preferably less than about 120° C., most preferably less than about 100° C., preferably at least about 20%, more preferably at least about 30% of the linkages disconnect, then re-connect upon cooling. The process is fully reversible and can be used to restore the fractured part of the polymer multiple times without the use of additional components, such as catalysts, monomers, or special surface treatment. The polymer preferably consists of a compound containing furan diene units, more preferably greater than two units, most preferably greater than four units. Additionally, the compound preferably contains an amine having maleimide dienophiles, more preferably greater than two dienophiles, most preferably greater than three dienophiles. Examples of such compounds include:

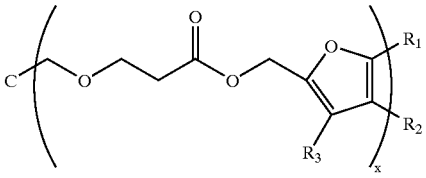

FURAN DIENE UNITS

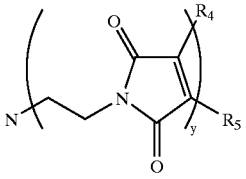

AMINE HAVING MALEIMIDE DIENOPHILES where $R_1$, $R_2$, $R_3$, $R_4$, and $R_5$ are hydrogen, alkyl, or aryl groups and x and y are greater than or equal to 2. Mechanical properties of the preferred compounds, which are reaction products of the diene and the dienophile, compared to epoxy resins and unsaturated polyesters, are presented in Table I below.

TABLE 1

| Properties | Experimental Polymer | Epoxy Resins | Unsaturated Polyesters | Test Methods |
|---|---|---|---|---|
| TENSILE | | | | D638, Type V |
| Strength (Mpa) | 68 | 27–88 | 4–88 | |
| Modulus (Gpa) | — | 2.4 | 2–4.4 | |
| Elongation (%) | 1.6–4.7 | 3–6 | <2.6 | |
| COMPRESSION | | | | D695 |
| Strength (Mpa) | 121 | 102–170 | 88–204 | |
| Modulus (Gpa) | 3.1 | 3.4 | | |
| FLEXURAL | | | | D790 |
| Strength (Mpa) | 143 | 88–143 | 58–156 | |
| Modulus (Gpa) | — | | 3.4–4.2 | |

Self-healing polymer layers may be produced in golf balls in accordance with the present invention by various techniques which are known in the art, such as by injection molding or compression molding a layer of self-healing polymer material about a previously formed center or core, cover, or intermediate layer. Cores comprising a self-healing polymer composition may also be formed directly by injection molding or compression molding. When the layer or core is injection molded, a physical or chemical blowing or foaming agent may be included to produce a foamed layer, if desired. Blowing or foaming agents useful in forming foamed polymer blends may be readily selected by one of ordinary skill in the art. In some cases, due to the very thin nature of the golf ball layer (less than 0.05 inches), it is not practical to form the outer cover layers of the ball of the present invention using conventional injection or compression molding techniques ordinarily employed in the golf ball art for applying cover materials. These conventional ball molding processes are not capable of easily applying such thin outer cover layers over a solid spherical surface.

Further compositions may also be added to the self-healing polymer components of the invention, such as, for example, coloring agents, reaction enhancers, crosslinking agents, blowing agents, dyes, lubricants, fillers (including density modifying fillers), excipients, process aids and other compounds commonly added to polymeric materials and/or golf ball compositions.

The composition of any golf ball component that does not contain the self-healing polymer composition disclosed herein can be any such composition known to those of ordinary skill in the art. Such compositions may be readily selected by those of ordinary skill in the art, for example, from one of the many U.S. Patents assigned to Acushnet Company. The resultant golf balls typically have a coefficient of restitution of greater than about 0.7, preferably greater than about 0.75, and more preferably greater than about 0.78. The golf balls also typically have a compression of at least about 40, preferably from about 50 to 120, and more preferably from about 60 to 100. As used herein, the term "compression" means as measured by an ATTI Compression Gauge. These gauges are well known to those of ordinary skill in the art and are commercially available from Atti Engineering Corp. of Union City, N.J.

Accordingly, it has been found by the present invention that the use of a castable, reactive material which is applied in a fluid form makes it possible to obtain very thin outer cover layers on golf balls. Specifically, it has been found that castable, reactive liquids which react to form a thermoset material provide desirable very thin outer cover layers.

The castable, reactive liquid employed to form the thermoset material can be applied over the inner core using a variety of application techniques such as spraying, dipping, spin coating or flow coating methods which are well known in the art. An example of a suitable coating technique is that which is disclosed in U.S. Pat. No. 5,733,428, filed May 2, 1995, the disclosure of which is hereby incorporated by reference in its entirety in the present application.

In a further embodiment, self-healing polymer blends may be formed by blending ceramic or glass microspheres with the self-healing polymer either during or before the molding process. Polymeric, ceramic, metal, and glass microspheres, foaming agents are useful in the invention, and may be solid or hollow and filled or unfilled. Microspheres up to about 1000 micrometers in diameter are useful in the polymer compositions of the invention. The present invention also includes the layer compositions that can be foamed by utilizing a well-known process in the art including the micro-cellular process.

For compression molded layers, half-shells made by injection molding a self-healing polymer composition in a conventional half-shell mold are used. The half-shells are placed about a previously formed center or core, cover, or mantle layer, and the assembly is introduced into a compression molding machine, and compression molded at about 250° F. to 400° F. The molded balls are then cooled while still in the mold, and finally removed when the layer is hard enough to be handled without deforming. Additional core, intermediate, and cover layers are then molded onto the previously molded layers, as needed, until a complete ball is formed. After the final cover layer of the ball has been molded, the ball undergoes various conventional finishing operations such as buffing, painting and stamping, all of which are well known in the art.

Blending of the self-healing polymer compositions and the optional additional polymers is accomplished in a conventional manner using conventional equipment. For example, a conventional injection molding machine may be used either to make preformed half-shells for compression molding or for molding flowable polymer compositions using a retractable-pin mold.

Conventional ionomers useful in this invention may include SURLYN®, ESCOR®, IOTEK®, and IMAC® copolymers. Such ionomers are obtained by providing thermolabile ionic crosslinking to polymers of monoolefin with at least one member selected from the group consisting of unsaturated mono- or di-carboxylic acids having 3 to 12 carbon atoms and esters thereof (the polymer contains 1 to 50% by weight of the unsaturated mono- or di-carboxylic acid and/or ester thereof). More particularly, such acid-containing ethylene copolymer ionomer component includes E/X/Y copolymers where E is ethylene, X is a softening comonomer such as acrylate or methacrylate present in 0–50 (preferably 0–25, most preferably 0–20), weight percent of the polymer, and Y is acrylic or methacrylic acid present in 5–35 (preferably 10–35, more preferably at least about 16–35, most preferably at least about 16–20) weight percent of the polymer, wherein the acid moiety is neutralized 1–100% (preferably at least 40%, most preferably at least about 60%) to form an ionomer by a cation such as lithium, sodium, potassium, magnesium, calcium, barium, lead, tin, zinc or aluminum, or a combination of such cations. Neutralization approaching and reaching 100% may be accomplished using a fatty acid or its salt. Specific acid-containing ethylene copolymers include ethylene/acrylic acid, ethylene/methacrylic acid, ethylene/acrylic acid/n-butyl acrylate, ethylene/methacrylic acid/n-butyl acrylate, ethylene/methacrylic acid/iso-butyl acrylate, ethylene/acrylic acid/iso-butyl acrylate, ethylene/methacrylic acid/n-butyl methacrylate, ethylene/acrylic acid/methyl methacrylate, ethylene/acrylic acid/methyl acrylate, ethylene/methacrylic acid/methyl acrylate, ethylene/methacrylic acid/methyl methacrylate, and ethylene/acrylic acid/n-butyl methacrylate. Preferred acid-containing ethylene copolymers include ethylene/methacrylic acid, ethylene/acrylic acid, ethylene/methacrylic acid/n-butyl acrylate, ethylene/acrylic acid/n-butyl acrylate, ethylene/methacrylic acid/methyl acrylate and ethylene/acrylic acid/methyl acrylate copolymers. The most preferred acid-containing ethylene copolymers are ethylene/methacrylic acid, ethylene/acrylic acid, ethylene/(meth)acrylic acid/n-butyl acrylate, ethylene/(meth)acrylic acid/ethyl acrylate, and ethylene/(meth)acrylic acid/methyl acrylate copolymers.

The manner in which the ionomers are made is well known in the art as described in, e.g., U.S. Pat. No. 3,262,272, which is incorporated herein in its entirety by reference.

As mentioned above, other suitable materials for forming the cover and/or intermediate layers, i.e., for use in combination with self healing polymers, include ionomers, polyurethanes, epoxy resins, polystyrenes, olefin based epoxy or anhydride copolymers, amine containing polymers, highly neutralized polymers as disclosed in WO 01/29129, acrylics, polyethylenes, polycarbonates, polyamides, polyesters, silicone polymers, silicone elastomers, and silicone resins. For example, the cover and/or intermediate layer may be formed from a blend of microencapsulated healing agents and catalyst and conventionally produced thermoplastic or thermoset urethanes/polyurethanes, urethane ionomers and urethane epoxies, polyurea, epoxy copolymers, anionic ionomers as disclosed in U.S. Pat. No. 6,221,960, single-site catalyzed polymers and blends thereof.

Among the suitable thermoplastic polyurethanes are block copolymers of copolyurethanes which typically contain blocks of a polyurethane oligomer (material with the higher softening point) alternating with lower softening point blocks of either a polyether oligomer, for a block copoly(ether-urethane), a polyester oligomer for a block copoly(ester-urethane) or a polybutadiene or hydrogenated polybutadiene oligomer for a block copoly(butadiene-urethane). The polyether oligomer is typically a polyether macroglycol, such as polytetramethylene ether glycol. The polybutadiene oligomer is a dihydroxy terminated polybutadiene oligomer, which may optionally be partially or fully hydrogenated. The polyurethane block typically consists of 4,4'-diphenylmethane diisocyanate, toluene diisocyanate (any combination of the 2,4- and 2,6-isomers) or paraphenylene diisocyanate, all chain extended with an aliphatic diol, typically 1,4-butanediol. Examples of suitable commercially available thermoplastic polyurethanes include the ESTANE® series from the B. F. Goodrich Company, which includes ESTANE® 58133, 58134, 58144 and 58311; the PELLETHANE® series from Dow Chemical, which includes PELLETHANE® 2102-90A and 2103-70A; ELASTOLLAN® from BASF; DESMOPAN® and TEXIN® from Bayer; and Q-THANE® from Morton International.

As noted above, self healing polymer candidates can also be blended with an epoxy resin. Examples of suitable commercially available epoxy resins include but are not limited to EPON® resins available from Shell and NOVALAC resins from Dow.

Suitable polyethylenes for blending as self healing polymers to form the cover and/or intermediate layer include homo and copolymers of ethylene containing functional groups such as maleic anhydride, carboxylic acid and hydroxyl groups. For example, these functional groups are introduced either by chemical grafting as in the case of grafting maleic anhydride such as that sold commercially under the tradename FUSABOND® by DuPont (Canada), or by copolymerizing the ethylene monomer with an unsaturated carboxylic acid comonomer such as a methacrylic acid sold commercially under the tradename NUCREL® by DuPont.

Catalysts such as manganese acetate, antimony oxide and titanium alkoxides are commonly used producing polyester polymers. Examples of suitable commercially available polyesters include materials sold under the tradenames EASTPAK® PET polyester and EASTAR® PETG from Eastman Chemicals, DACRON® and TERLENE® from DuPont.

Examples of other specific polymers or families of polymers which may be used in conjunction with self healing polymers in golf ball cover and/or intermediate layer compositions include: poly (ethylethylene), poly (heptylethylene), poly(hexyldecylethylene), poly (isopentylethylene), poly(1,1-dimethyltrimethylene), poly (1,1,2-trimethyltrimethylene), aliphatic polyketones (such as ethylene-carbon monoxide-propylene sold commercially under the tradename CARILON by Shell), poly(butyl acrylate), poly(2-ethylbutyl acrylate), poly(heptyl acrylate), poly(2-methylbutyl acrylate), poly(3-methylbutyl acrylate), poly(octadecyl methacrylate), poly(butoxyethylene), poly (methoxyethylene), poly(pentyloxyethylene), poly(1,1-dichloroethylene), poly(cyclopentylacetoxyethylene), poly(4-dodecylstyrene), poly(4-tetradecylstyrene), poly (oxyethylethylene), poly(oxytetramethylene), poly(silanes), poly(silazanes), poly(furan tetracarboxylic acid diimides), and poly(vinylidene fluoride), as well as the classes of polymers to which they belong.

The invention is further directed to a golf ball cover and/or intermediate layer composition comprising a blend of self healing polymers in conjunction with non-ionomeric thermoplastic polymers. For example, such non-ionomeric thermoplastic polymers may include: block copolymer of poly(ether-ester) copolymers, such as HYTREL® available from DuPont, partially or fully hydrogenated styrene-butadiene-styrene block copolymers, such as the KRATON D® grades available from Shell Chemical, styrene-(ethylene-propylene)-styrene or styrene-(ethylene-butylene)-styrene block copolymers, such as the KRATON G® series from Shell Chemical, Septon HG-252 from Kurary, either of the KRATON®-type copolymers with maleic anhydride or sulfonic graft or hydroxyl functionality, such as the KRATON FD® or KRATON FG® series available from Shell Chemical, olefinic copolymers, such as the ethylene-methyl acrylate or ethylene-butyl acrylate series available from Quantum Chemical, ethylene-octene copolymers made with metallocene catalysts, such as the AFFINITY® or ENGAGE® series available from Dow, ethylene-alpha olefin copolymers and terpolymers made from metallocene catalysts, such as the EXACT® series available from Exxon, block copolymer of poly(urethane-ester) or block copolymer of poly(urethane-ether) or block copolymer of poly(urethane-caprolactone), polyethylene glycol, such as CARBOWAX® available from Union Carbide, polycaprolactone, polycaprolactam, polyesters, such as EKTAR® available from Eastman, ethylene-propylene-(diene monomer) terpolymers and their sulfonated or carboxylated derivatives, and SANTOPRENE® from Monsanto. The invention is further directed to a golf ball cover and intermediate layer comprising poly(trimethylene terephthalate).

Other examples of non-ionomeric thermoplastic elastomer polymers can be selected from the group consisting of a block copolymer of copoly(ester-ester), a block copolymer of copoly(ester-ether), a block copolymer of copoly (urethane-ester), a block copolymer of copoly(urethane-ether), a block polystyrene thermoplastic elastomer comprising an unsaturated rubber, a block polystyrene thermoplastic elastomer comprising a functionalized substantially saturated rubber, a thermoplastic and elastomer blend comprising polypropylene and ethylene-propylene-diene monomer terpolymer or ethylene-propylene copolymer rubber where the rubber is dynamically vulcanized, poly(ethylene terephthalate), poly(butylene terephthalate), poly(vinyl alcohol), poly(vinyl acetate), poly(silane), poly (vinylidene fluoride), acrylonitrile-butadiene-styrene copolymer, olefinic polymers, their copolymers, including functional comonomers, and mixtures thereof.

One-piece golf balls comprising self-healing polymers, either alone or as a blend with other polymers, two-piece golf balls comprising a cover surrounding a core and wound golf balls, in which a liquid, semi-solid, or solid core is surrounded by an elastic synthetic material are all within the scope of the invention. Any type of golf ball core can be used in the golf balls of the invention. However, preferred cores include some amount of cis-polybutadiene.

The polymer blends of this invention can be prepared with or without the addition of a compatibilizer and with varying molecular architecture of blend components, such as varying molecular weight, tacticity, degrees of blockiness, etc., as is well known to those knowledgeable in the art of blending polymers.

Blending of the polymers is accomplished in a conventional manner using conventional equipment. Good results may be obtained by mixing the polymers or resins in a solid, pelletized form and then placing the mix into a hopper which is used to feed the heated barrel of an injection molding machine. Further mixing is accomplished by a screw in the heated barrel. The injection molding machine is used either to make preformed half-shells for compression molding about a core or for molding flowable cover stock about a core using a retractable-pin mold. Such machines are conventional.

Additionally, conventional components, known to those skilled in the art, which can be added to the cover compositions of the invention include white pigments, optical brighteners, processing aids and UV stabilizers such as TINUVIN® 213 and TINUVIN® 328. Also, light stabilizers such as, for example, TINUVIN® 770 and TINUVIN® 765, may also be used. TINUVIN® products are available from Ciba-Geigy. Dyes, as well as fluorescent pigments may also be used in the golf ball covers produced with polymers formed according to the invention. Such additional ingredients may be used in any amounts that will achieve their desired purpose. However conventional amounts range of from about 0.05% to about 1.5%, or more preferably, from about 0.5% to about 1.0%.

Other conventional ingredients, e.g., fillers are well known to the person of ordinary skill in the art and may be included in cover and intermediate layer blends of the invention in amounts effective to achieve their known purpose.

An optional filler component may be chosen to impart additional density to blends of the previously described components. The selection of such filler(s) is dependent upon the type of golf ball desired (i.e., one-piece, two-piece multilayer or wound), as will be more fully detailed below. Generally, the filler will be inorganic, having a density greater than about 2 g/cc, preferably greater than 4 g/cc, and will be present in amounts between 5 and 65 weight percent based on the total weight of the polymer components. Examples of useful fillers include metals, such as tungsten and titanium; metal alloys, such as brass and bronze; metal oxides, such as zinc oxide and calcium oxide; metal salts, such as barium sulfate, lead silicate and tungsten carbide; and other well known corresponding salts and oxides thereof.

Self-healing polymers may be incorporated into conventional core compositions to form cores for two-piece balls or centers of wound balls. Conventional core compositions comprise polybutadiene as the elastomer and, in parts by weight based on 100 parts polybutadiene (pph), 20–50 pph of a metal salt acrylate derivative such as zinc diacrylate, zinc dimethacrylate, or zinc monomethacrylate, preferably zinc diacrylate. The core compositions of this invention may be foamed or unfoamed.

The compositions of the invention may also include fillers, added to the elastomeric composition to adjust the density and/or specific gravity of the core. Fillers useful in the golf ball core according to the invention include, for example, zinc oxide, calcium oxide, barium sulfate, and regrind (which is recycled core molding matrix ground to 20 mesh particle size). The amount and type of filler utilized is governed by the amount and weight of other ingredients in the composition, since a maximum golf ball weight of 1.620 ounces has been established by the USGA. Appropriate fillers, including reactive fillers, known by those skilled in the art, generally have a specific gravity in the range of from about 2.0 to 5.6.

Antioxidants may also be included in the elastomer cores produced according to the invention. Antioxidants are compounds which prevent the breakdown of the elastomer. Antioxidants useful in the invention include, but are not limited to, quinoline type antioxidants, amine type antioxidants, and phenolic type antioxidants.

Other ingredients such as accelerators, e.g., tetra methylthiuram, processing aids, processing oils, plasticizers, dyes and pigments, as well as other additives well known to the skilled artisan may also be used in the invention in amounts sufficient to achieve the purpose for which they are typically used.

The core compositions of the invention may be produced by forming a mixture comprising, for example, polybutadiene, zinc diacrylate. In preparing the core compositions, when a set of predetermined conditions is met, i.e., time and temperature of mixing, the free radical initiator is added in an amount dependent upon the amounts and relative ratios of the starting components, all of which would be well understood by one of ordinary skill in the art. In particular, as the components are mixed, the resultant shear causes the temperature of the mixture to rise. Peroxide(s) free radical initiator(s) and optionally a trans-converting agent such as organic or inorganic sulfides are blended into the mixture for crosslinking purposes in the molding process.

After completion of the mixing, the golf ball core composition is milled and hand prepped or extruded into pieces ("preps") suitable for molding. The milled preps are then compression molded into cores at an elevated temperature. These cores can then be used to make finished golf balls by surrounding the cores with an intermediate layer and/or cover materials.

Layers including a composition of self healing polymers may be produced in golf balls in accordance with the invention by injection molding or compression molding a layer of the self healing polymer composition about a previously formed center or core, cover, or intermediate layer. Cores comprising a self-healing composition may also be formed directly by injection molding or compression molding. When the layer or core is injection molded, a physical or chemical blowing or foaming agent may be included to produce a foamed layer. Blowing or foaming agents useful in forming foamed compositions include, but are not limited to organic blowing agents, such as azobisformamide; azobisisobutyronitrile; diazoaminobenzene; N, N-dimethyl-N, N-dinitroso terephthalamide; N,N-dinitrosopentamethylene-tetramine; benzenesulfonylhydrazide; benzene-1,3-disulfonyl hydrazide; diphenylsulfon-3-3, disulfonyl hydrazide; 4,4'-oxybis benzene sulfonyl hydrazide; p-toluene sulfonyl semicarbizide;

barium azodicarboxylate; butylamine nitrile; nitroureas; trihydrazino triazine; phenyl-methyl-uranthan; p-sulfonhydrazide; peroxides; and inorganic blowing agents such as ammonium bicarbonate and sodium bicarbonate. A gas, such as air, nitrogen, carbon dioxide, etc., can also be injected into the blend during the injection molding process.

In a further embodiment, compositions may be formed by blending microspheres with the self healing polymer composition either during or before the molding process. Polymeric, ceramic, metal, and glass microspheres are useful in the invention, and may be solid or hollow and filled or unfilled. Microspheres up to about 1000 $\mu$m in diameter are useful in the self-healing polymer compositions of the invention.

The invention is further directed to a method of making a golf ball. The method comprises, in one embodiment, the steps of forming a golf ball core by conventional means and subsequently forming a cover around the core by either compression molding preformed half-shells of cover stock material comprising a self-healing polymer composition about the core or by injection molding cover stock material comprising the self-healing polymer composition about the core.

The present invention relates to golf balls of any size. While USGA specifications limit the size of a competition golf ball to more than 1.68 inches in diameter, golf balls of any size can be used for leisure golf play. The preferred diameter of the golf balls is from about 1.68 inches to about 1.8 inches. The more preferred diameter is from about 1.68 inches to about 1.76 inches. A diameter of from about 1.68 inches to about 1.74 inches is most preferred. The cover of the golf balls typically has a thickness of at least about 0.03 inches, preferably 0.03 to 0.125 inches, and more preferably from about 0.05 to 0.1 inches. The golf balls also typically have at least about 60 percent dimple coverage, preferably at least about 70 percent dimple coverage, of the surface area.

PROPHETIC EXAMPLE

Golf balls of the present invention can be manufactured as follows. The core may be made using either a conventional wound core construction or a conventional two piece core construction formed using methods well known in the art. The wound core construction can be either a solid rubber-based center or a liquid filled center around which a length of elastic thread is wound. A conventional two-piece construction preferably comprises a cis 1,4 polybutadiene rubber that has been crosslinked with a metal salt of an unsaturated fatty acid such as zinc diacrylate.

These core constructions are then covered using a conventional compression molding technique with an inner cover layer of an ionomer having a methacrylic acid content of at least about 16 weight percent (preferably SURLYN® 8140 or SURLYN® 8546).

The cover formulation containing the self-healing polymer is as follows:

FORMULATION

| Component | #1 | #2 |
|---|---|---|
| MDI - PTMEG prepolymer | 1 eq. | 1 eq. |
| Versalink P-250 | 0.95 eq. | 0.95 eq. |
| Color Dispersion | 3.5% | 3.5% |
| Dicyclopentadiene-filled microcapsules | 10% | — |
| Grubb's Catalyst | 2.5% | — |

-continued

FORMULATION

| Component | #1 | #2 |
|---|---|---|
| Diene (multi-furan) | — | 5% |
| Dienophile (multi-imide) | — | 5% |

*percentages in addition to the total resin composition

The outer cover layer can be formed following the processes set forth in U.S. Pat. No. 5,006,297 and U.S. Pat. No. 5,334,673. A particularly desired material for forming the outer cover layer is castable urethane with a Shore D hardness ranging from 30 to 70.

It is believed that golf balls made in accordance with the present invention will exhibit appreciably greater impact durability than conventional golf balls. The self healing polymers of the present invention may also be used in golf equipment, such as golf club inserts (i.e., a putter insert), golf clubs and shafts, golf shoe components, and coatings golf equipment.

As used herein, the term "about," used in connection with one or more numbers or numerical ranges, should be understood to refer to all such numbers, including all numbers in a range.

While it is apparent that the illustrative embodiments of the invention herein disclosed fulfills the objective stated above, it will be appreciated that numerous modifications and other embodiments may be devised by those skilled in the art. Therefore, it will be understood that the appended claims are intended to cover all such modifications and embodiments which come within the spirit and scope of the present invention.

What is claimed is:

1. A golf ball comprising a core and a cover disposed concentrically about the core, wherein at least one of the core or the cover is comprised of a polymer having thermally reversible covalent bonds.

2. The golf ball of claim 1, wherein at least about 20% of the thermally reversible covalent bonds disconnect upon heating to a first temperature and re-connect upon cooling to a second temperature.

3. The golf ball of claim 1, wherein at least about 30% of the thermally reversible covalent bonds disconnect upon heating to a first temperature and re-connect upon cooling to a second temperature.

4. The golf ball of claim 2, wherein the first temperature is less than about 150° C.

5. The golf ball of claim 4, wherein the first temperature is less than about 120° C.

6. The golf ball of claim 5, wherein the first temperature is less than about 100° C.

7. The golf ball of claim 1, wherein the thermally reversible polymer comprises at least one furan diene unit and at least one amine comprising maleimide dienophiles.

8. The golf ball of claim 7, wherein the furan diene units have the formula:

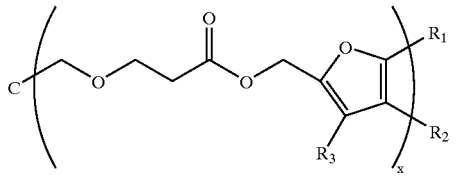

where $R_1$, $R_2$, and $R_3$ are hydrogen, alkyl, or aryl groups and x is 4 and the amine comprising maleimide dienophiles has the formula:

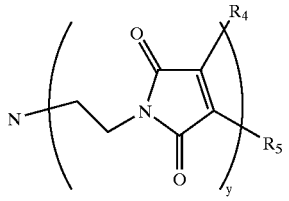

where $R_4$ and $R_5$ are hydrogen, alkyl, or aryl groups and y is 3.

9. The golf ball of claim 7, wherein the polymer comprises at least 4 furan diene units and at least 3 maleimide dienophiles.

10. The golf ball of claim 1, wherein the core comprises a center and an outer core layer.

11. The golf ball of claim 10, wherein the center comprises a solid center, a hollow center, a gel, or a fluid.

12. The golf ball of claim 1, wherein the cover comprises an inner cover layer and an outer cover layer.

13. The golf ball of claim 12, wherein the inner or outer cover layer has a thickness of between about 0.03 inches and about 0.125 inches.

14. The golf ball of claim 1, wherein at least one of the core or cover is foamed, comprises a density-modifying filler, or both.

* * * * *